United States Patent [19]

Metzinger

[11] Patent Number: 4,920,638

[45] Date of Patent: May 1, 1990

[54] METHOD AND DEVICE FOR THE PRODUCTION OF WIRE JOINTED BAND

[76] Inventor: Friedrich Metzinger, Max-Reger-Str. 14, D-600 Frankfurt am Main 70, Fed. Rep. of Germany

[21] Appl. No.: 281,870

[22] Filed: Dec. 7, 1988

Related U.S. Application Data

[63] Continuation of Ser. No. 46,872, filed as PCT DE86/00352 on Sep. 3, 1986, published as WO87/01314 on Mar. 12, 1987, abandoned.

[30] Foreign Application Priority Data

Sep. 4, 1985 [DE] Fed. Rep. of Germany ... 8525221[U]

[51] Int. Cl.[5] ..... B23P 21/00

[52] U.S. Cl. ..... 29/786; 29/789; 140/3 R

[58] Field of Search ..... 29/793, 797

[56] References Cited

U.S. PATENT DOCUMENTS 4,459,733 7/1984 Bachmann et al. ..... 140/3 R X
4,477,959 10/1984 Burnecke et al. ..... 29/450 X
4,520,559 6/1985 Takahashi et al. ..... 29/410 X

*Primary Examiner*—Joseph M. Gorski
*Attorney, Agent, or Firm*—Oldham & Oldham

[57] ABSTRACT

There is described a method and a device for the production of a wire jointed-band of alternately clockwise and counterclockwise, respectively, wound spirals of metal wire or artificial resin wire, wherein the spirals are guided to a narrow pass such that the windings providing the spirals open themselves in the area of the narrow pass and in this the parallel spirals partly are pushed into each other such that in each case one of the windings of one spiral is placed between adjacent windings of the adjacent spiral whereby the spirals thus fitted into each other are connected with each other by inserting a coupling wire into the space provided by the overlapping windings and whereby in each case several of the pairs of spirals fitted into each other are guided to the narrow space in which area the spirals are driven in the transporting direction. This is resulting in a high production speed and broad wire jointed-bands.

6 Claims, 2 Drawing Sheets

METHOD AND DEVICE FOR THE PRODUCTION OF WIRE JOINTED BAND

Figure 1:
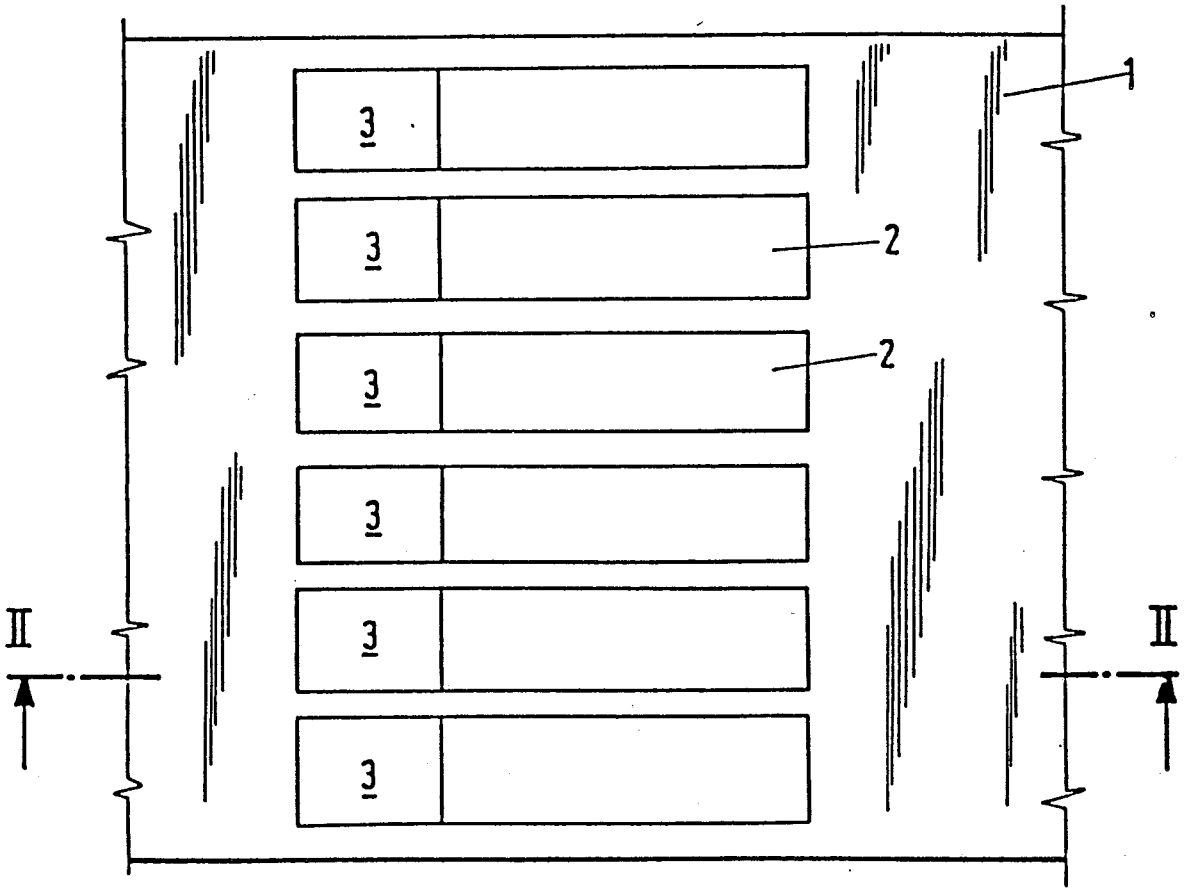

This is a continuation of co-pending application Ser. No. 046,872 filed as PCT DE86/00352 on Sep. 3, 1986, published as WO87/01314 on Mar. 12, 1987, now abandoned.

DESCRIPTION

The invention relates to a method and a device for the production of a wire jointed-band of alternately clockwise and counterclockwise, respectively, wound spirals of metal wire or artificial resin wire. The method according to the invention in this is starting from method steps according to which the spirals are guided to a narrow pass such that the windings providing the spirals are opening themselves in the area of the narrow pass and the parallel spirals in this are partly pushed into each other such that in each case one of the windings of one spiral is placed between adjacent windings of the adjacent spiral, and wherein the spirals fitted into each other in this way are connected with each other by insertion of a coupling wire into the space provided by the themselves overlapping windings.

DE-A-30 17 378 and parallel EP-A-39 850, respectively, are describing such a method. Here, the narrow pass is provided like a zipper slide, and in each case at least three of the spirals are guided to the narrow pass with a tension biasing. With a certain spacing behind the narrow pass a driven pair of rollers is provided which is lying upon the upper side and the lower side of the in this way formed wire jointed-band thereby effecting the transport of the spirals and the subsequently provided wire jointed-band through the narrow pass. It is already stated here that the center spiral also can be guided to the narrow pass from above.

The known method, however, has several disadvantages. Becasue three of each alternately clockwise and counter-clockwise wound spirals are guided to the narrow pass, one of these spirals necessarily is guided loosely, i.e. it has no counterpart. According to this method broad wire jointed-bands only can be produced with difficulty, at least without a relatively high production speed and not without substantial failures. Depending upon the already completed wire jointed-band being subject to tension in transporting direction behind the narrow pass, the tension biased, adjacent windings of the spirals are opening themselves in the area of the narrow pass possibly in a different way, wherein this is particularly the case in a comparison of each center spiral with both adjacent spirals. The side spirals are openend by the narrow pass somewhat more precisely than the center spiral which is not leaving its straight alignment. Smmarizing it can be said that the spirals freely guided to the narrow pass do not open there its windings as precisely and that also at higher production speeds certainly exactly one winding of the spiral each is placed between two adjacent windings of the adjacent spiral. It may rather happen that for instance also two windings of the same spiral are placing themselves into one of the intermediate spaces between the windings of the adjacent spiral which naturally is leading to a failure and thus to scrap of the wire jointed-band produced according to this method.

The invention is avoiding these disadvantages. It is based upon the object to propose a method and a device by which the spirals for producing the wire jointed-band always are pushed into each other satisfactorily at the area of the narrow pass also at higher production speeds whereby particularly broad wire jointed-bands can be produced.

For solving this problem the invention is characterized in that in each case several pairs of spirals pushed into each other are guided to the narrow pass in which area the spirals are driven in transporting direction.

Thus the disadvantageous tension upon the already completed wire jointed-band in transporting direction behind the narrow pass is avoided; rather the spirals themselves are driven in the area of the narrow pass. Moreover, no single free spirals each are guided to the narrow pass but spirals which have already been pushed into each other to several pairs in a preceding working operation. Thereby the single windings of the spirals are brought already into a predetermined spacing to each other and fixed there because they have sufficient biasing for remaining in their position. The windings of the spiral pairs fixed to some extent in their spacings are guided thus according to the invention to the narrow pass where they are fitted into each other without difficulty.

Because already in the area of the narrow pass itself force for the transport of the structure is excersized upon same there are resulting no different strong elongations of the single spirals with their windings which have led to the described failures. According to this method, therefore, strong and particularly broad wire jointed-bands can be produced in one working operation.

It is preferred that the spiral pairs are guided to the narrow pass from different direction from above and below, respectively, because this facilitates the bending up of the spirals in the area of the narrow pass.

It is further preferred that the structure providing the narrowing of the narrow pass is excersizing the transporting force upon the spirals. Thereby the transporting force is exactly localized at the correct place, i.e. in the area of the narrow pass itself.

Moreover it is preferred when pressure is excersized upon the spiral pairs in the narrow pass which is proceeding substantially vertically to the plane of the wire jointed-band produced there. As the narrow pass usually is provided as gap, this is attained by a narrowing of the free cross-section of the gap in its height and depth, respectively, different to the preferred teaching of the mentioned DE-PS where the narrow pass is provided as zipper slide, i.e. at the side walls of the gap.

A broad wire jointed-band is produced in a particularly simple manner if several structures spirals fitted into each other which are laterally displaced to each other are guided to the narrow pass alternately from above and below, respectively.

The device for carrying out this method according to the invention is starting from a guide plate at which a narrowing of the cross-section is provided which is forming a narrow pass for a band-like structure of the spirals placed there substantially parallel. This device is already described in the mentioned DE-PS 30 17 378. The guide plate there, as already mentioned, is provided in a manner like a zipper. The narrowing of the cross-section is extending there in the direction of width of the band-like structure provided by the spirals pushed into each other, having the disadvantages already described.

For solving the problem of the invention the device according to the invention is characterized by the narrowing of the cross-section being provided in the direction of the height of the band-like structure and being provided by a part of the guide plate as well as by the circumference of a roller driven rotatably.

The spirals, already fitted into each other in pairs are guided to the guide plate with its narrowing of cross-section alternately from above and below in each case one or several pairs. In order to attain this the invention is further characterized in that there is provided in transporting direction of the band-like structure in front of the narrowing of the cross-section and above and below the plane of the guide plate at least each one upper and a lower guide, respectively, for the spirals fitted into each other.

In the following the invention is described in detail in an embodiment from which further important features are resulting.

Figure 2:
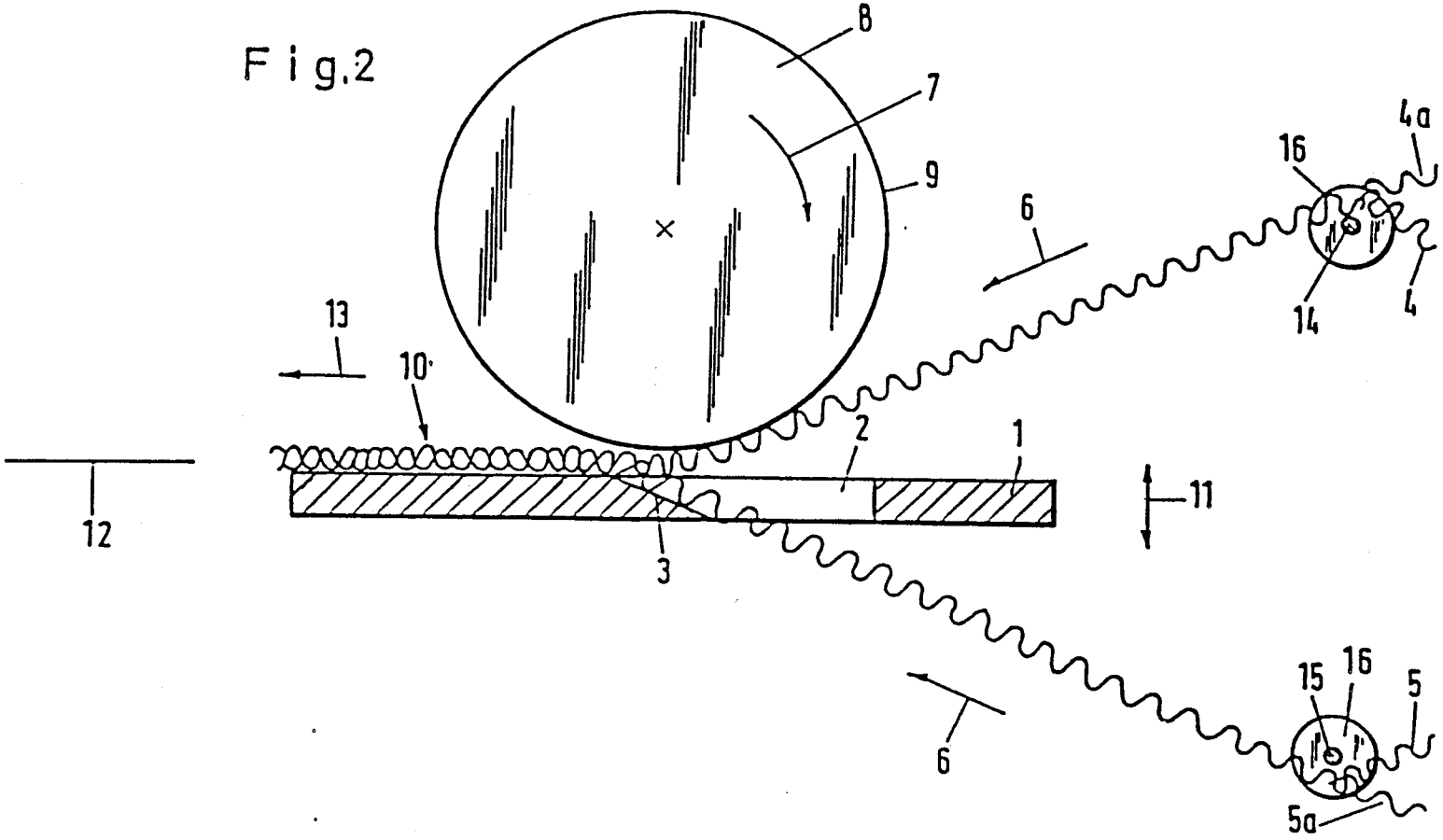

FIG. 1—is showing a topview of the guide plate;

FIG. 2—is showing a section along line II-II of FIG. 1 with further components of the device according to the invention, wherein also the guiding of the spirals fitted into each other in pairs and their assembly is indicated.

In a guide plate 1 shown in the figures slots 2 adjacent and parallel to each other are provided. In the embodiment six of these slots are proposed. Preferably the slots have an inclined rear edge 3. The number and the width of the slots is depending on the respective realities. An even number of slots is preferred since the structures then will better support themselves.

To each slot 2 at least each one structure 4, 5 of spirals already fitted into each other in pairs is guided in the direction of arrows 6. (For clarification FIG. 2 is only showing one single spiral 4 and 5, respectively, which in reality, however, is a pair of spirals.)

Directly above slots 2 in the direction of arrow 7 there is provided a roller 8 driven rotatably. Together with edge 3 the generated surface of roller 8 is forming a narrow pass and narrowing of the cross-section, respectively, for the band-like structure of the assembled pairs 4, 5. This narrowing pass is thus extending in the height of this band-like structure 10, i.e. in the direction of the double arrow 11. By providing this narrow pass the pairs or structure 4, 5 of the spirals already fitted into each other are bent apart in the direction of the height so that the upper spirals 4 are opening below and the lower spirals to the above. By this, the spirals are properly pushed into each other and formed to the band-like structure, consisting of a row of several spiral pairs fitted into each other. Into each one pair of spirals fitted into each other from the open front side still a pin wire 12 is fitted which is also indicated in FIG. 2. In the shown embodiment the wire jointed-band produced according to this method is consisting of totally thirtysix spirals. This number can, of course, be increased or decreased, just according to the desired conditions. The completed wire jointed-band then is leaving the device in the direction of arrow 13.

The generated surface 9 is consisting preferably of a suitable rubber-flexible material, in order to exercize in the area of the narrow pass the required driving force in transporting direction 13 upon the band-like structure and the spirals providing the band-like structure, respectively. Moreover, the spacing in the direction of the double arrow 11 between the guide plate 1 and the roller 8 is adjustable in adaptation to differently large spirals. Plate 1 is interchangable to another plate with a different number and/or another width or slots 2 in adaptation to the width of the wire jointed-band each to be produced.

Upper and lower guide rolls 14, 15, respectively or other guide means are guiding the spiral pairs, about which the upper and lower spiral pairs 4, 5, respectively are guided. On the guide rolls spaced from each other guide washers 16 are pinned which between themselves each provide a guiding space for one of the pairs 4 and 5, respectively. Thus the spiral pairs 4, 5 are also guided in axial direction of the guide rolls.

The drive for roller 8 can be adjusted carefully within a certain range of speed. For simplification, this drive is not shown.

The before mentioned spiral structures 4, 5 are in each case consisting of a spiral pair. It is, however, preferred that to each slot 2 several spiral pairs are guided. This is indicated in FIG. 2 with additional spiral pairs **4*a*, 5*a* which are guided to the narrow pass in the plane of spiral pairs 4 and 5**, respectively.

Pairs **4, 4*a* and 5, 5*a*** are also joined together before the narrow pass so that in this example four spirals are guided to each slot.

For instance, if plate 1 has six slots then in this example $6 \times 4 = 24$ spirals are guided from below. The spiral pairs guided from above which are not passing through the slots then increase the total number of spirals manufactured to the wire jointed-band to 44.

If to the plate a larger number of double spirals, possibly one of four spirals are guided at respective widening of its slots then the wire jointed-band worked in one working step is becoming substantially wider and the production speed is increased. The production speed can for instance be doubled by respective arrangement.

Even more spiral pairs can be guided to every slot which, however, are already joined with each other before the narrow pass, at least as far as same are guided to the narrow pass from one direction (structure **4, 4*a* and 5, 5*a***, respectively).

Because of the mutual guiding of the spirals the even number of the joined spirals to spiral pairs, one of four spirals, one of six spirals and so on before the narrow pass is important.

I claim:

1. A device for producing a wire jointed-band, comprising a narrow pass provided between a roller driven in a transporting direction and a plate positioned adjacent said roller to form a space between said roller and said plate to define the narrow pass, said plate having a plurality of parallel slots having one end positioned near to said narrow pass and extending in a direction opposite from said transporting direction, said parallel slots having inclined portions at the said end near to the narrow pass, the plate existing in a first plane, the axis of rotation of the roller existing in a second plane which is perpendicular to the first plane, the inclined portions being intersected by said second plane, wherein a plurality of parallel, alternatively clockwise and counterclockwise, respectively, wound spirals of wire which are fitted into each other to form a plurality of pairs of fitted spirals are directed to said narrow pass and opened by deflection in the vicinity of said narrow pass such that said pairs fit and partly overlap into each other, wherein a plurality of said fitted spirals are guided to said narrow pass from above and below said plate to form a wire jointed band having a plurality of overlapped fitted spirals.

2. A device according to claim 1, wherein, said inclined portions extend upwardly in said transporting direction at the location of said narrow pass to facilitate guiding of said fitted spiral from below said plate, and extend from just before the narrow pass to just past the narrow pass.

3. The device according to claim 1, wherein, said roller has a drive force generating surface having a resilient material thereon.

4. The device according to claim 1, wherein the cross-section of said narrow pass is reduced between said roller and said plate in said transporting direction so as to assert a transporting force on said fitted spirals.

5. The device according to claim 4, wherein, said transporting force is applied at the location of said narrow pass, and is substantially perpendicular to a plane of the wire jointed-band formed at the location of said narrow pass.

6. The device according to claim 1, wherein a coupling wire is provided for insertion into said partly overlapping areas of said spirals so as to retain spirals in a secured relationship.

* * * * *